US005278040A

United States Patent [19]

Ohya et al.

[11] Patent Number: 5,278,040

[45] Date of Patent: Jan. 11, 1994

[54] SILVER HALIDE PHOTOGRAPHIC LIGHT SENSITIVE MATERIAL

[75] Inventors: Yukio Ohya; Shuji Murakami; Masanobu Miyoshi; Hideaki Maekawa, all of Hino, Japan

[73] Assignee: Konica Corporation, Tokyo, Japan

[21] Appl. No.: 934,861

[22] Filed: Aug. 24, 1992

[30] Foreign Application Priority Data

Sep. 3, 1991 [JP] Japan ..... 3-223004

[51] Int. Cl.[5] ..... G03C 1/08; G03C 7/26; G03C 7/32

[52] U.S. Cl. ..... 430/555; 430/551; 430/533

[58] Field of Search ..... 430/555, 551, 533

[56] References Cited

U.S. PATENT DOCUMENTS 4,283,486 8/1981 Aono et al. ..... 430/551
4,914,013 4/1990 Ikesu et al. ..... 430/555
4,954,431 9/1990 Nishijima et al. ..... 430/555

FOREIGN PATENT DOCUMENTS 350286 1/1990 European Pat. Off. .
62-157032 7/1987 Japan .

OTHER PUBLICATIONS

Patent Abstracts of Japan, vol. 11, No. 391 (P-649) [2838] Dec. 22, 1987 JPA-62-157032; Jul. 13, 1987.

*Primary Examiner*—Charles L. Bowers, Jr.

*Assistant Examiner*—Geraldine Letscher

*Attorney, Agent, or Firm*—Jordan B. Bierman, Bierman and Muserlian

[57] ABSTRACT

A reflective silver halide photographic light-sensitive material is disclosed. The light-sensitive material comprises a reflective support having thereon a silver halide emulsion layer wherein the support have an oxygen permeability of not more than 2.0 ml/m$^2$·hr·atm and the silver halide emulsion layer contains a magenta coupler represented by the following Formula I;

wherein Ar is an aryl group; Y is a hydrogen atom or a substituent capable of splitting off upon reaction with the oxidation product of a color developing agent; X is a halogen atom, an alkoxy group or an alkyl group; R is a strait- or branched-chain alkyl group having 1 to 20 carbon atoms; J is a strait- or branched-chain alkylene group; and n is an integer of from 0 to 4, when n is 2 or more, the plurality of Xs may be the same or different. The light-sensitive material is excellent in red color reproducibility and light fastness of red colored images.

5 Claims, No Drawings

SILVER HALIDE PHOTOGRAPHIC LIGHT SENSITIVE MATERIAL

FIELD OF THE INVENTION

The present invention relates to a silver halide photographic light-sensitive material, more particularly, to a silver halide color photographic light-sensitive material excellent in red color reproducibility and light stability.

BACKGROUND OF THE INVENTION

As magenta couplers used for silver halide color photographic light-sensitive material (hereinafter, referred to also as "color light-sensitive material") for the purpose of color reproduction by means of a subtractive color system, a 5-pyrazolone coupler, a cyanoacetophenone coupler, an indazolone coupler, a pyrazolobenzimidazole coupler, a pyrazolotriazole coupler are known.

Among them, the 5-pyrazolone coupler has a defect that the color tone in red color is incomplete while the dye images formed by the couplers are excellent in light fastness (light stability).

As couplers improving the above-mentioned color tone, pyrazolo triazole type couplers described in U.S. Pat. No. 3,725,067, Japanese Patent Publication Open to Public Inspection (hereinafter, referred to as Japanese Patent O.P.I. Publication) Nos. 99437/1984, 162548/1984 and 171956/1984, Research Disclosure (RD) Nos. 24230, and 24531 are cited. However, the light stability of dye images formed by the above-mentioned couplers were fairly inferior. Especially, when it was used in light-sensitive materials for prints which are for direct appreciation, it shows its deteriorated essential conditions as a photographic light-sensitive material to stock and record images. Therefore, it was difficult to be put to practical use.

On the other hand, since it has been known that oxygen is one of the causes of the deterioration of light fastness of coloring dye images, techniques to improve light fastness by intercepting dye images from oxygen have also been proposed For example, in Japanese Patent O.P.I. Publication Nos. 11330/1974 and 57223/1975, techniques to enclose coloring dye images with an oxygen-intercepting layer composed of substances having low transmissivity for oxygen, for example, to laminate with polyester, are described. However, the above-mentioned methods were not completely satisfactory, though they showed effects to some extent. In the case of some couplers, they had a defect to deteriorate light fastness to the contrary. In addition, the number of operation processes are many and complicated. Therefore, the above-mentioned technologies are costly and therefor are not practical.

In addition, in Japanese Patent O.P.I. Publication No. 158324/1986, a technique to use a support having low oxygen transmissivity is described. However, light fastness of image is still unsatisfactory.

SUMMARY OF THE INVENTION

Accordingly, the object of the present invention is to provide a silver halide color photographic light-sensitive material for reflective images use having magenta color dye images excellent in color reproducibility (especially, red color) and light fastness.

The above-mentioned object of the present invention is attained by a silver halide photographic light-sensitive material comprising a support having thereon at least one silver halide emulsion layer, wherein the support is a reflective support having oxygen permeability of not more than 2.0 ml/m$^2$·hr·atm and the silver halide emulsion layer contains at least one magenta coupler represented by the following Formula I;

Formula I

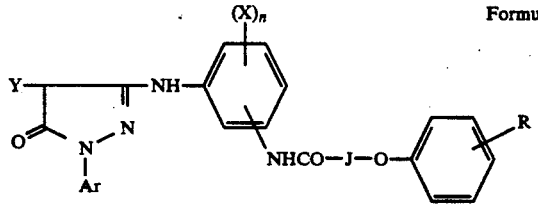

wherein Ar represents an aryl group; Y represents a hydrogen atom or a substituent capable of being split off through the reaction on an oxidation product of color developing agent; X represents a halogen atom, an alkoxy group or an alkyl group; R represents a straight-chain or branched-chain alkyl group having 1 to 20 carbon atoms; J represents a straight-chain or a branched-chain alkylene group; n represents an integer of 0 to 4; and a plurality of Xs may be the same or different when n is 2 or more.

DETAILED DESCRIPTION OF THE INVENTION

The oxygen permeability of the support in the present invention can be measured by means of conventional methods. For example, it is defined in ASTM D-1434.

Any kind of support can be used for the present invention so far as the oxygen permeability is not more than 2.0 ml/m$^2$·hr·atm. Preferably, it is not more than 1.0 ml/m$^2$·hr·atm. As a support satisfying aforesaid requirement, a plastic film can be cited.

As polymers forming a plastic film, polyester such as polyethyleneterephthalate, homopolymer or copolymer of vinylalcohol, vinylchloride, vinylfluoride and vinylacetate, acrylonitrile, alkylester acrilic acid, alkylester metacrylate, metacrylonitrile, alkylvinylester, alkylvinyleter and polyamide, and cellulose acetate.

Of the above-mentioned polymers, particularly preferable is polyester. In addition, polyester film has no humidity dependency on oxygen permeability. Therefore, even in high humidity, it is preferable to have the same oxygen permeability as in low humidity.

The support in the present invention may contain white pigment or may be coated with a hydrophilic colloidal layer containing a white pigment on a transparent support in order to provide reflectivity.

As a white pigment, inorganic and/or organic white pigments are used. The preferable are inorganic white pigments including sulfate of alkaline earth metal such as barium sulfate, carbonate of alkaline earth metal such as calcium carbonate, fine silica such as powder of silicic acid and synthetic silicate, calcium silicate, alumina, alumina hydrate, titanium oxide, zinc oxide, talc and clay are cited. The preferable white pigments are barium sulfate, calcium carbonate and titanium oxide. The more preferable is titanium oxide.

When the above-mentioned white pigments are contained in the above-mentioned plastic film support, it is preferable that white pigments are contained in an amount of 5 to 50% by weight to the weight of polymers forming a plastic film.

The light-sensitive material of the present invention is suitable for direct appreciation use. The reflective support in the present invention is preferable to be white in terms of visual feeling. As a property representing whiteness, whiteness degree is cited. As a whiteness degree, for example, a value measured on the basis of methods defined in JIS Z-8722 and Z-8730 is used. Based on it, it is preferable to be L*80% or more, and more preferable to be L*90% or more. In addition, a* −1.0 to +1.0 and b* −2.0 to −5.0 are preferable.

It is preferable that the reflective support in the present invention is glossy. As a property representing a gloss, a glossiness degree is cited. As a glossiness degree, there is a value measured on the basis of a method defined in JIS Z-8741. Based on it, not less than 40% is preferable, and not less than 60% is more preferable.

A reflective support in the present invention may have appropriate rigidity in terms of handling. As a property representing rigidity, stiffness is cited. As stiffness, there is a value measured on the basis of a method defined in TAPPI T-489. Based on it, it is preferable that LD (stiffness in the longitudinal direction) is not less than 8 g and TD (stiffness in the transversal direction) is not less than 8 g.

The thickness of a reflective support in the present invention may be thick or thin, as far as the oxygen transmissivity is not more than 2.0 ml/m$^2$·hr·atm. For example, in terms of a value of thickness measured based on a method defined in JIS P-8118, 10 to 300 μm is preferable and 50 to 200 μm is more preferable.

In the foregoing formula I, an aryl group represented by Ar is preferably a phenyl group having a substituent.

As preferable substituents include, a halogen atom such as a fluorine atom, a chlorine atom and a bromine atom, alkyl groups such as a methyl group, an ethyl group and a butyl group, alkoxy groups such as a methoxy group and an ethoxy group, aryloxy groups such as a phenoxy group and a naphthoxy group, acylamino groups such as an α-(2,4-di-t-amylphenoxy)butylamide group and a benzamide group, a sulfonamide group such as a hexadecanesulfonamide group and a benzenesulfonamide group, sulfamoyl groups such as a methylsulfamoyl group and a phenylsulfamoyl group, carbamoyl groups such as a butylcarbamoyl group and a phenylcarbamoyl group, sulfonyl groups such as a methylsulfonyl group, a dodecylsulfonyl group and a benzenesulfonyl group, an acyloxy group, an alkoxycarbonyl group, a carboxyl group, a sulfo group, a cyano group and a nitro group.

As groups capable of being split off through reaction with an oxidation product of color developing agent represented by Y include, for example, halogen atoms such as a chlorine atom, a bromine atom and a fluorine atom, an alkoxy group, an aryloxy group, a heterocyclic oxy group, an acyloxy group, a sulfonyloxy group, an alkoxycarbonyloxy group, an aryloxycarbonyl group, an alkyloxalyloxy group, an alkoxyoxalyloxy group, an alkylthio group, an arylthio group, a heterocyclic thio group, an alkoxythiocarbonylthio group, an acylamino group, a sulfonamido group, a nitrogen-containing heterocycle bound with the copler moiety through the N atom thereof, an alkyloxycarbonylamino group and an aryloxycarbonylamino group.

X represents a halogen atom, for example, a chlorine atom, a bromine atom and a fluorine atom, an alkoxy group, for example, a methoxy group, an ethoxy group and a buthoxy group and an alkyl group, for example, a methyl group, an ethyl group, an i-propyl group, a butyl group and a hexyl group.

As alkyl groups represented by R include, for example, a methyl group, a t-butyl group, a t-amyl group, a t-octyl group, a nonyl group and a dodecyl group.

The preferable straight-chained or branched-chained alkylene group represented by J are a methylene group, which may have an alkyl substituent, or a trimethylene group, which may have an alkyl substituent. The more preferable is a methylene group, and the more preferable is a methylene group having an alkyl group with 1 to 20 carbons, for example, a hexyl-methylene group, an octyl-methylene group and a dodecylmethylene group. Of them, the most preferable is a methylene group having an alkyl substituent with 1 to 4 carbons such as a methyl-methylene group, an ethyl-methylene group, a propylmethylene group, an i-propyl-methylene group and a butylmethylene group.

As practical examples of magenta couplers represented by Formula I are as follows.

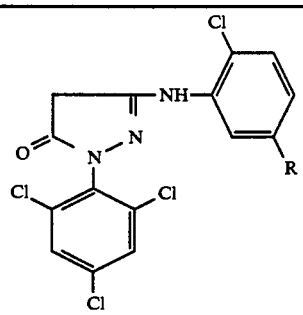

| No. | R |
|---|---|
| M-1 | 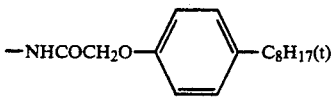 |
| M-2 | 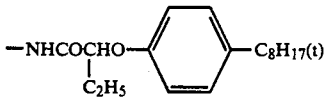 |

-continued
M-3
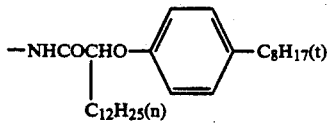
M-4
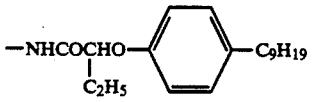
M-5
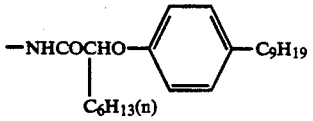
M-6
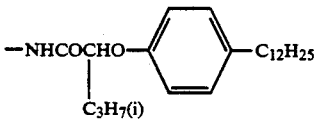
M-7
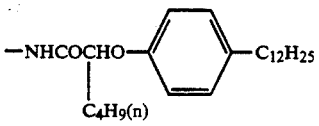
M-8
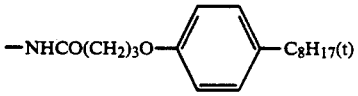
M-9
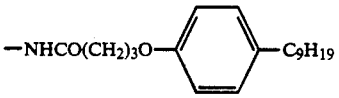
M-10
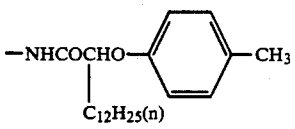
M-11
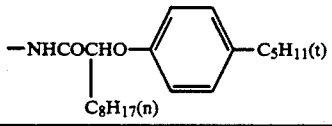
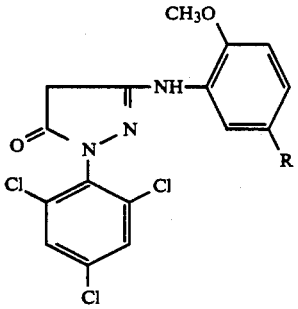
| No. | R |
|---|---|

-continued
M-12
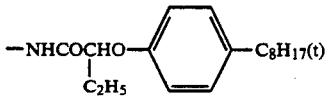
M-13
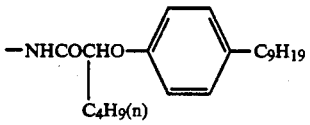
M-14
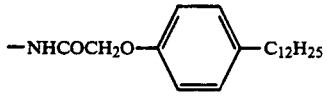
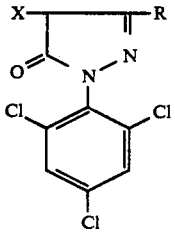
| No. | X | R |
|---|---|---|
| M-15 | H— | 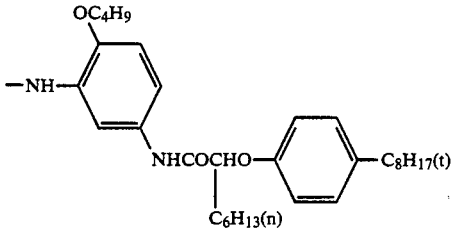 |
| M-16 | 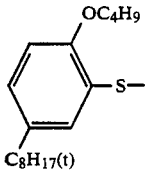 | 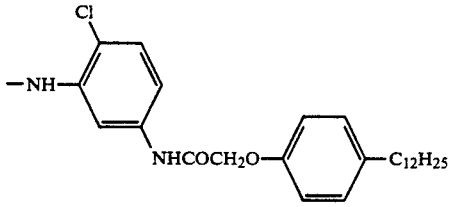 |
| M-17 | H— | 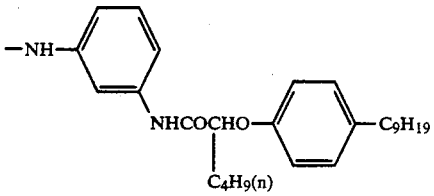 |
| M-18 | 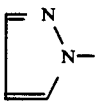 | 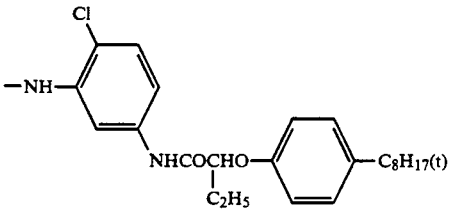 |

-continued
M-19 H—
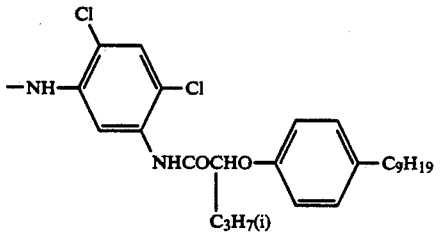
M-20
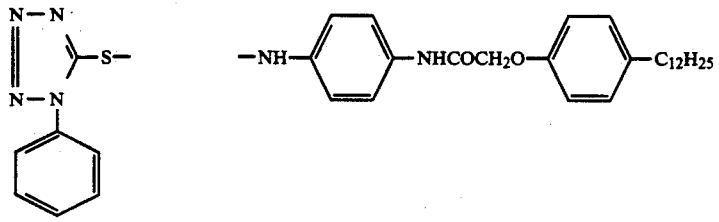
M-21
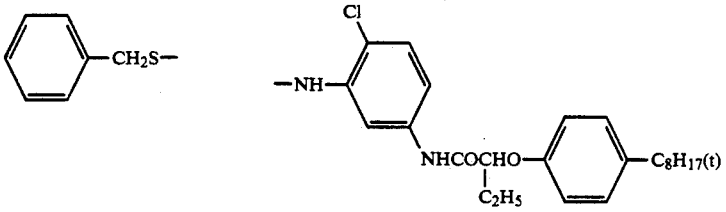
M-22 $CF_3CONH$—
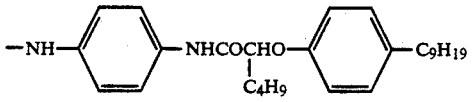
M-23
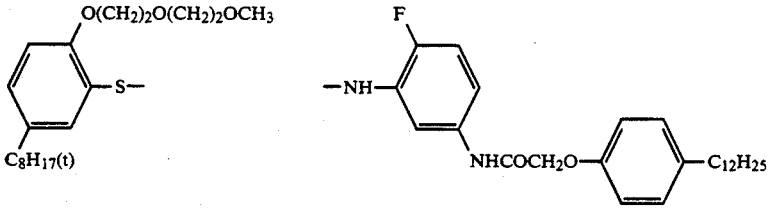
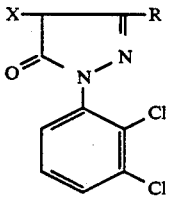
| No. | X | R |
|---|---|---|
| M-24 | H— | 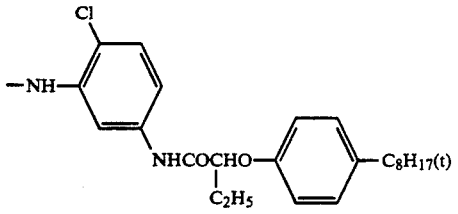 |

-continued
M-25
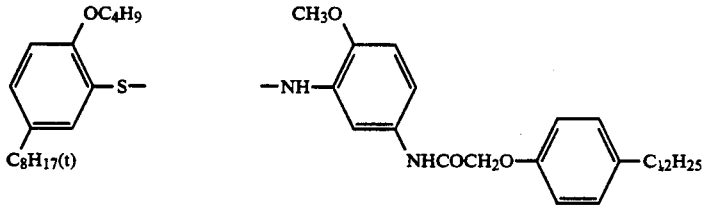
M-26
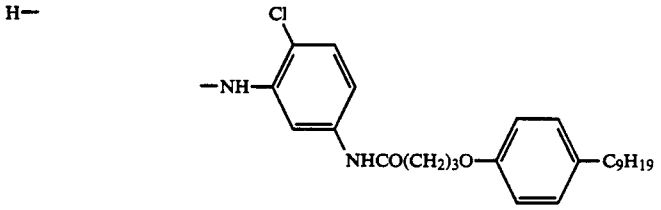
M-27
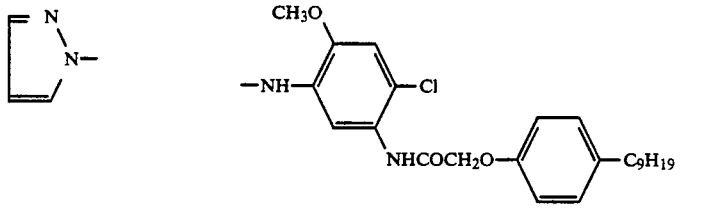
M-28
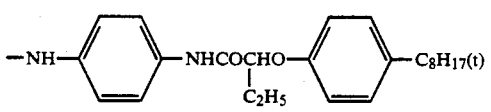
M-29
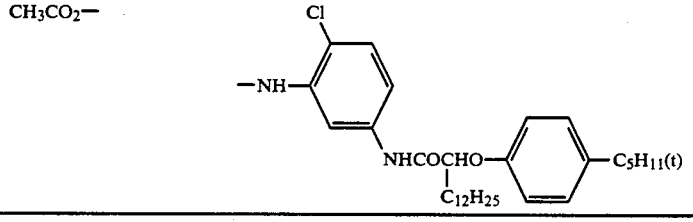
M-30
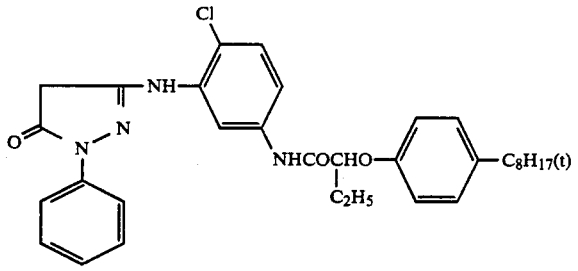
M-31
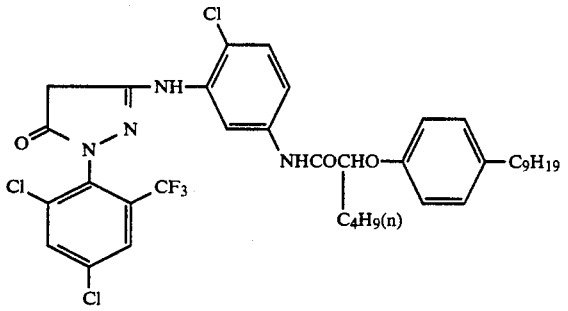

-continued

M-32

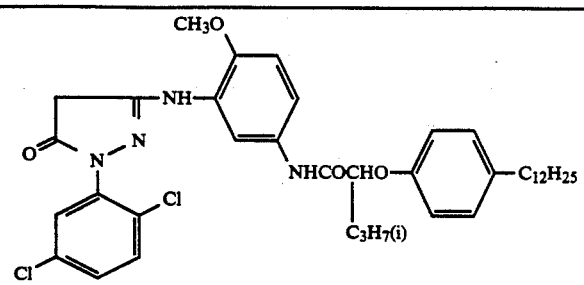

M-33

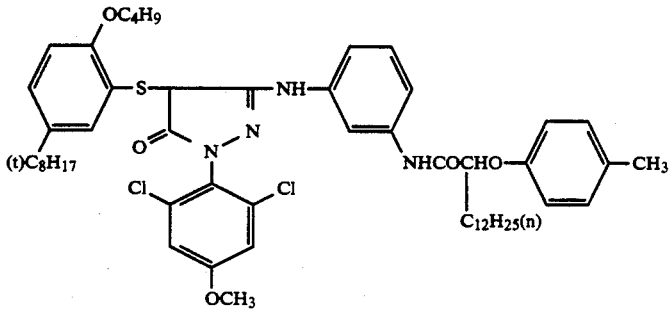

M-34

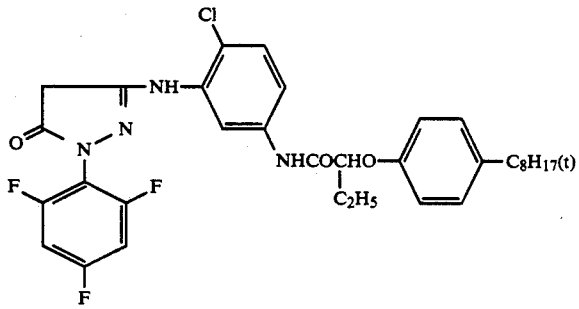

Magenta couplers in the present invention can be used in the range of $1\times10^{-3}$ to $8\times10^{-1}$ mol and preferably in the range of $1\times10^{-2}$ to $5\times10^{-1}$ mol per mol of silver halide contained the emulsion layer in which the coupler to be added.

Other magenta couplers may be used in combination provided that the effect of the present invention is not damaged.

Effects of the present invention can be demonstrated effectively when the color light-sensitive material in the present invention is used for a color printing subjected to direct appreciation.

The color light-sensitive material of the invention mainly used for color prints may be for mono color use or multi color use. In the case of silver halide photographic light-sensitive material for multi-color use, it has a structure to laminate silver halide emulsion layers wherein each of magenta, yellow and cyan coupler is contained as couplers for photographic use and nonsensitive layers in a proper layer numbers and order in order to conduct color reproduction by means of subtractive color system. Said number of layers and order may be changed appropriately depending upon a property to be stressed and purpose to be used.

As yellow couplers may be used in a light sensitive material of the present invention, conventional open-chained ketomethylene type coupler can be cited. In addition, benzoyl acetoanilido type and pyvaloyl acetoanilido couplers can be used advantageously. Practical examples of them are described in U.S. Patent Nos. 2,875,057, 3,265,506, 3,277,155, 3,408,194, 3,415,652, 3,447,928 and 3,664,841 and Japanese Patent Publication No. 13574/1974, Japanese Patent O.P.I. Publication Nos. 29432/1973, 66834/1973, 10736/1974, 122335/1974, 28834/1975 and 132926/1975.

As cyan couplers, derivatives of phenol or naphthol are suitable. Practically, they are described in U.S. Pat. Nos. 2,423,730, 2,474,293, 2,801,171, 2,895,826, 3,476,563, 3,737,316, 3,758,308 and 3,839,044, Japanese Patent O.P.I. Publication Nos. 37425/1972, 10135/1975, 25228/1975, 112038/1975, 117422/1975, 130441/1975, 109630/1978, 163537/1980, 29235/1981, 55945/1981, 65134/1981, 80045/1981, 99341/1981, 116030/1981, 104333/1981, 31953/1984 and 124341/1984.

In addition, it is preferable that oxidation inhibitor is used in combination in layers containing couplers in light sensitive material of the present invention.

As oxidation inhibitors, compounds described in U.S. Pat. Nos. 3,935,016, 3,982,944, 4,254,216, 3,700,455, 3,764,337, 3,432,300, 3,574,627 and 3,573,050, British No. 1,347,556, British Patent Open to Public Inspection Nos. 2,066,975, 2,077,455 and 2,062,888, Japanese Patnt O.P.I. Publication Nos. 21004/1980, 145530/1979, 152225/1977, 20327/1978, 17729/1978 and 6321/1980 and Japanese Patent Publication Nos. 12337/1979 and 31625/1973 are useful.

In order to contain couplers in the present invention and aforesaid oxidation inhibitor used in combination preferably in an emulsion, conventional methods can be used. After the coupler is dissolved independently or mixedly in a high boiling organic solvent, for example, ester phthalate such as dibutylphthalate and dioctylphthalate, ester phosphate such as tricresylphosphate, triphenylphosphate and trioctylphosphate and N,N-dialkyl-substituted amidos such as N,N-diethyl laurinamido or low boiling organic solvent such as ethyl acetate, butyl acetate and butyl propionate or the mixed solvent thereof, the solution is mixed up with an aqueous gelatin solution containing a surfactant. The mixture is so emulsified as to be dispersed with a high speed rotary mixer, a colloid mill, or a ultrasonic homogenizer, to be added to a silver halide emulsion used in the present invention.

For a silver halide emulsion used for a color light-sensitive material in the present invention, conventional silver halide emulsions such as silver bromide, silver bromoiodide, silver chloroiodide, silver chlorobromide and silver chloride can be arbitrary used as a silver halide. In terms of suitabiiity for rapid processing, silver chloride and silver bromochloride are preferable.

The silver halide emulsion can be chemically sensitized by a conventional method. Namely, a sulfur sensitization method employing compounds containing sulfur capable of reacting on silver ion and active gelatin, a selenium sensitization method employing selenium compounds, a reduction sensitization method employing reductive substances and a noble metal sensitization method employing gold and other noble metal compounds can be used independently or in combination.

The silver halide emulsion can be optically sensitized to a desired wavelength employing dyes known as a sensitizing dye in the field of photography. A sensitizing dye can be used independently or in combination. In addition to sensitizing dye, a super-sensitizer which is a dye having no property of spectral sensitization by itself or a compound substantially absorbing no visible light and which enhances sensitization function of sensitization dyes may be contained in an emulsion.

To a silver halide emulsion in the present invention, compound known as anti-fogging agents or stabilizers in the industry of photography can be added during chemical ripening and/or at the end of chemical ripening and/or after the end of chemical ripening and before the silver halide emulsion is coated for the purpose of preventing fogging and/or keeping photographic property stably in the course of manufacturing the light-sensitive material, stocking or photographic processing.

As a hydrophilic binder for silver halide emulsion layers and nonsensitive layers in the present invention, gelatin is useful. Gelatin derivatives, graft polymers of gelatin and other polymers, other proteins, sugar derivatives, cellulose derivatives and hydrophilic colloid such as synthetic hydrophilic polymer substances including monopolymers and copolymers can also be used.

As gelatin, in addition to lime-process gelatin, acid-process gelatin and enzyme-process gelatin described in page 30 of Bulletin Society of Science of Photography of Japan (Bull. Soc. Sci. Phot. Japan.) No.16 can be employed. Besides, hydrolysis product of gelatin and enzyme-decomposed product of gelatin can be used.

As gelatin derivatives, those obtained by reacting various kind of compounds including halide cid, acid anhydride group, isocyanate group, bromoacetate, alkanesulfone group, vinylsufonamido group, maleinimide compounds, polyalkyleneoxydo group, polyalkylene oxide group and epoxy compounds on gelatin. Practical examples of them were described in US Patent Nos. 2,614,928, 3,132,945, 3,186,846 and 3,312,553, British Patent Nos. 861,414, 1,033,189 and 1,005,784 and Japanese Patent Publication No.26845/1967.

As protein, albumin and casein are preferable. As cellulose derivatives, hydroxyethyl cellulose, carboxymethyl cellulose and sulfric ester of cellulose are preferable. As sugar derivatives, sodium alginic acid and starch derivatives are preferable.

As graft polymers of aforesaid gelatin and other polymers, those wherein acrylic acid and metacrylic acid and ester derivative and amido derivative thereof and vinyl type monomer including acrylonitrile and styrene grafted on gelatin independently or in combination can be used. Particularly, it is preferable to be graft polymers with polymers having compatibility with gelatin to some extent such as acrylic acid, acrylamide, metacrylamide and hydroxylmetacrylate. Examples of them are described in U.S. Patent Nos. 2,763,625, 2,831,767 and 2,956,884.

Typical synthetic hydrophilic polymers includes monopolymers or copolymers of polyvinyl alcohol, partially acetalized polyvinyl alcohol, poly-N-vinylpyrolidone, polyacrylate, polymetacrylate, polyacrylamide, polyvinylimidazole and polyvinylpyrazole. They are described in German Patent Application (OLS) No. 2,312,708 and U.S. Pat. Nos. 3,620,751 and 3,879,205 and Japanese Patent Publication No. 7561/1968.

The total amount of binder contained in light-sensitive silver halide emulsion layers and nonsensitive hydrophilic colloidal layers on the photographic constitution layer on a side wherein a silver halide emulsion layer is coated on a support is preferably not more than 8.0 g/m$^2$ and not less than 5.0 g/m$^2$.

Employing the magenta coupler in the present invention, and by reducing the total amount of binder to be not more than 8.0 g/m$^2$, satisfactory light durability can be obtained and it turned out that red color reproducibility becomes clearer compared with the case when the total amount of binder exceeds 8.0 g/m$^2$. This effect was unexpected.

EXAMPLES

Example 1

On a paper support wherein 25 μm of polyethylene was laminated on one side and 25 μm of polyethylene containing 15 g of titanium oxide was contained per 100 g was laminated on the other side on the side of the first layer, layers described in Tables 1 and 3 were coated to prepare a multi-layer color light-sensitive material. Each coating solution was prepared as follows.

Coating solution for First layer

To 26.5 g of a yellow coupler (Y-1), 10.0 g of image dye stabilizer (ST-1), 0.46 g of additive (HQ-1) and 10 g of high boiling organic solvent (DNP), 60 mμ of ethyl acetate was added to be dissolved. The solution was dispersed to 220 ml of 10% gelatin aqueous solution containing 7 ml of 20% surfactant (SU-1) by means of a supersonic homogenizer to prepare a yellow coupler dispersant.

The above-mentioned dispersant was mixed with a blue sensitive silver halide emulsion containing 10 g of silver prepared by the following conditions to prepare First layer coating solution.

Second layer coating solution to Seventh layer coating solution were prepared in the manner similar to First layer coating solution.

TABLE 1

| Layer | Constitution | Added amount ($g/m^2$) |
|---|---|---|
| First layer (Blue sensitive layer) | Gelatin | 1.4 |
| | Blue sensitive silver bromochloride emulsion | 0.3 |
| | Yellow coupler (Y-1) | 0.8 |
| | Dye image stabilizer (ST-1) | 0.3 |
| | Color mixture preventing agent (HQ-1) | 0.015 |
| | DNP | 0.3 |
| Second layer (Intermediate layer) | Gelatin | 1.0 |
| | Compound (F-1) | $9.4 \times 10^{-3}$ |
| | Fluorescent whitening agent W-1) | 0.12 |
| | Color mixture preventing agent (HQ-1) | 0.02 |
| | Color mixture preventing agent (HQ-2) | 0.06 |
| | DIDP | 0.13 |
| | Anti-stain agent (HQ-3) | $2.3 \times 10^{-4}$ |
| Third layer (Green sensitive layer) | Gelatin | 1.3 |
| | Green sensitive silver bromochloride emulsion | 0.28 |
| | Magenta coupler (M-1) | 0.35 |
| | Dye image stabilizer (ST-2) | 0.1 |
| | Dye image stabilizer (ST-3) | 0.2 |
| | Dye image stabilizer (ST-4) | 0.015 |
| | Color mixture preventing agent (HQ-2) | 0.01 |
| | DIDP | 0.28 |
| | Anti-irradiation dye (AI-1) | $4.0 \times 10^{-3}$ |
| Fourth layer (UV absorbing layer | Gelatin | 0.95 |
| | UV absorber (UV-1) | 0.28 |
| | UV absorber (UV-2) | 0.01 |
| | UV absorber (UV-3) | 0.38 |
| | Color mixture preventing agent (HQ-1) | 0.04 |
| | Anti-irradiation dye (AI-2) | 0.012 |
| | Anti-irradiation dye (AI-3) | $5.7 \times 10^{-3}$ |
| | Anti-stain agent (HQ-3) | $1.8 \times 10^{-3}$ |
| | Catecol derivative (AO-1) | $7.0 \times 10^{-3}$ |
| | DNP | 0.40 |

TABLE 2

| Layer | Constitution | Added amount ($g/m^2$) |
|---|---|---|
| Fifth layer (Red sensitive layer) | Gelatin | 1.4 |
| | Red sensitive silver chloride emulsion | 0.23 |
| | Magenta coupler (C-1) | 0.13 |
| | Cyan coupler (C-2) | 0.26 |
| | Dye image stabilizer (ST-1) | 0.20 |
| | Additive (HQ-1) | $5.5 \times 10^{-3}$ |
| | DOP | 0.20 |
| Sixth layer (UV absorber) | Gelatin | 0.50 |
| | UV absorber (UV-1) | 0.23 |
| | UV absorber (UV-2) | 0.07 |
| | UV absorber (UV-3) | 0.16 |
| | Color mixture preventing agent (HQ-1) | 0.016 |
| | Anti-irradiation dye (AI-2) | $5.3 \times 10^{-3}$ |
| | Anti-irradiation dye (AI-3) | $2.4 \times 10^{-3}$ |
| | Anti-stain agent (HQ-3) | $7.5 \times 10^{-3}$ |

TABLE 2-continued

| Layer | Constitution | Added amount ($g/m^2$) |
|---|---|---|
| | Catecol derivative (AO-1) | $3.0 \times 10^{-3}$ |
| | DNP | 0.20 |
| Seventh layer (Protective layer) | Gelatin | 1.0 |
| | Silicon dioxide | $3.0 \times 10^{-3}$ |
| | Color mixture preventing agent (HQ-1) | $1.5 \times 10^{-3}$ |
| | Color mixture preventing agent (HQ-2) | $4.5 \times 10^{-3}$ |
| | Compound (F-1) | $9.4 \times 10^{-3}$ |
| | DIDP | 0.005 |

The added amounts of silver halide emulsion are indicated in terms of silver.

As coating aids, (SU-2) and (SU-3) were employed. As hardeners, (H-1) and (H-2) were employed. Blue sensitive silver bromochloride emulsion A silver bromochloride emulsion having an average grain size of 0.7 μm and silver bromide content of 90 mol % was sensitized most suitably at 57 ° C. employing sodium thiosulfate, and then, a sensitizing dye (BS-1) and a stabilizer (STAB-1) were added thereto. Green sensitive silver bromochloride emulsion A silver bromochloride emulsion having an average grain size of 0.5 μm and silver bromide content ratio of 70 mol % was sensitized most suitably at 59 ° C. employing sodium thiosulfate, and then, a sensitizing dye (GS-1) and a stabilizer (STAB-1) were added thereto. Red sensitive silver bromochloride emulsion A silver bromochloride emulsion having an average grain size of 0.40 μm and silver bromide content ratio of 60 mol % was sensitized most suitably at 60 ° C. employing sodium thiosulfate, a sensitizing dye (RS-1) and phenol resin, and then, a stabilizer (STAB-1) was added thereto.

Additives used for preparing the light-sensitive material are as follows:

HQ-1 : 2,5-di-t-octylhydroquinone

HQ-2 : A mixture of 2-i-hexadecyl-5-methylhydroquinone and 2-i-octadecyl-5-methylhydroquinone HQ-3 : 2-acetoamino-5-mercapto-1H-1,3,4-triazole SU-1 : Sodium di(2-ethylhexyl)sulfosuccinate SU-2 : Sodium di(2,2,3,3,4,4,5,5-octafluoropentyl) sulfosuccinate SU-3 : Sodium tri-i-propylnaphthalenesulfonate H-1 : Sodium salt 2,4-dichloro-6-hydroxy-s-triazine H-2 : Tetra(vinylsulfonylmethyl)methane ST-1 : 2,6-di-t-butyl-4-[(2,4-di-t-pentyl)phenoxycarbonyl] phenol ST-2 : Bis[(2-hydroxy-3-t-butyl-5-methyl)phenyl]methane ST-3 : 1,4-di(buthoxy)-2,5-di-t-butylbenzene ST-4 : 1,4-di(octyloxy)-2,5-di-t-pentylbenzene DOP : Dioctylphthalate DNP : Dinonylphthalate DIDP : Diisodecylphthalate AO-1 : Sodium catecol-3,5-disulfonate STAB-1: 4-hydroxy-6-methyl-1,3,3a,7-tetrazaindene -continued
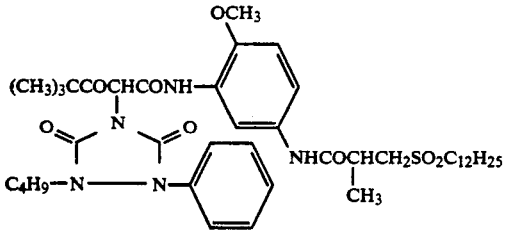
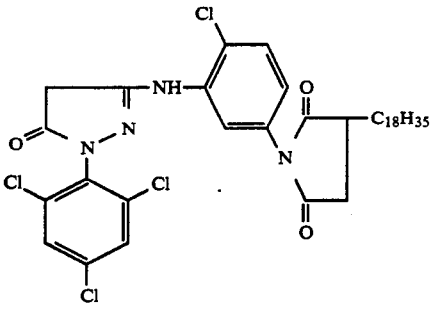
M-2
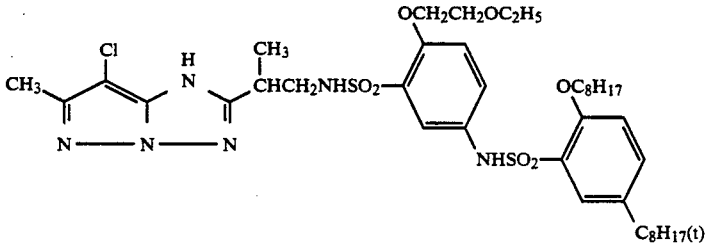
C-1
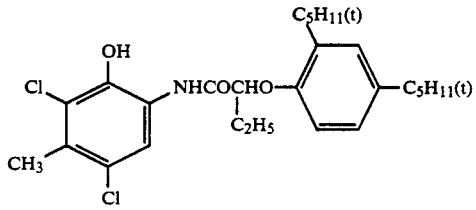
C-2
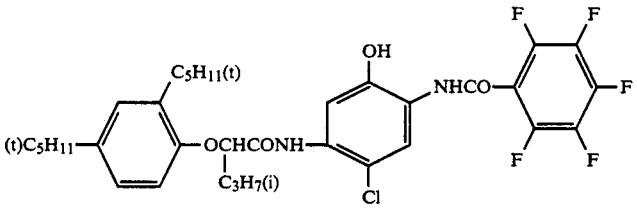
UV-1
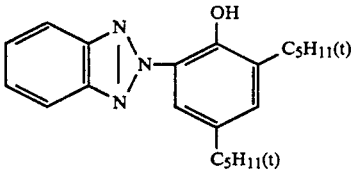
UV-2
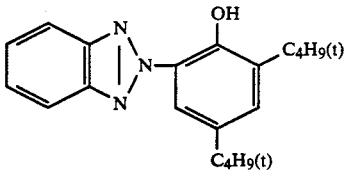
UV-3
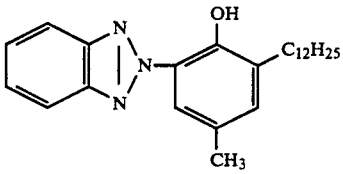
F-1 (Mixture of the following 3 components)
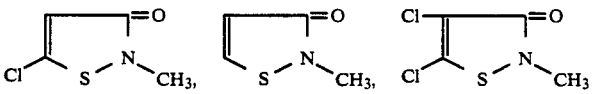
(Component A) (Component B) (Component C)
A:B:C = 50:46:4 (mol ratio)
W-1

-continued

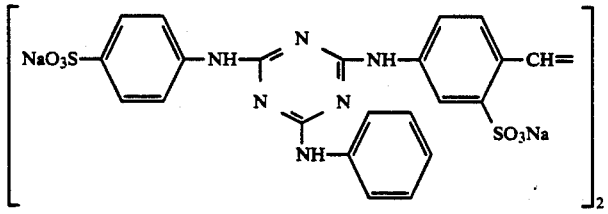

AI-1

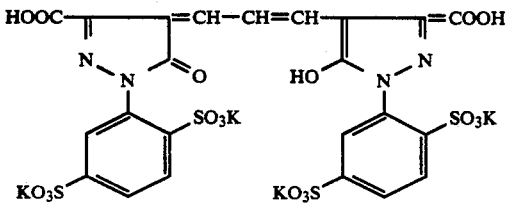

AI-2

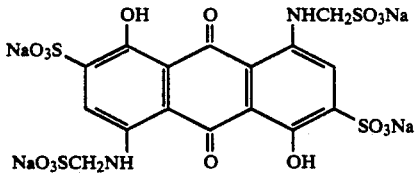

AI-3

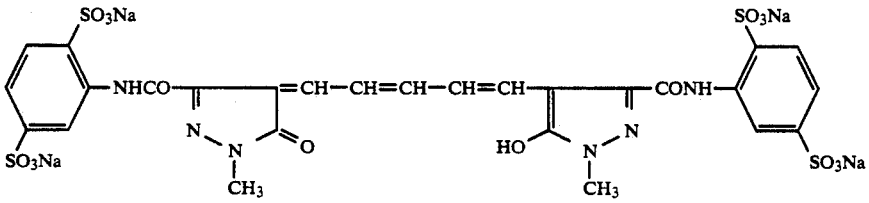

BS-1

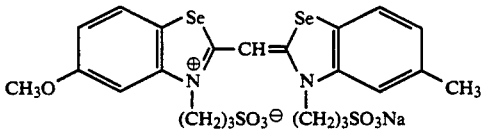

GS-1

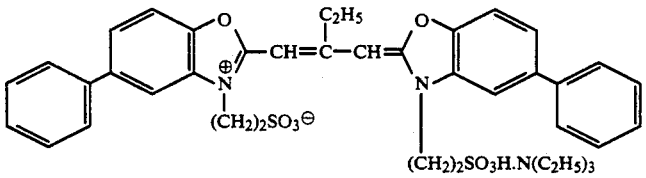

RS-1

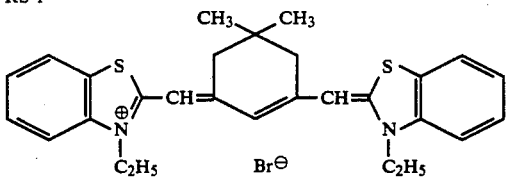

The sample thus obtained is defined to be Sample 101. Samples 102 to 111 were prepared in the same manner as Sample 101 excepting that the support and the magenta coupler in the third layer are modified as shown in Table 4. Incidentally, the supports are indicated by abbreviations, and the contents are shown in Table 3.

TABLE 3

| Abbreviation of support | Contents of support |
|---|---|
| PE | A paper support wherein 25 μm of polyethylene containing 15 g of titanium dioxide in 100 g of polyethylene are laminated on both surfaces |
| TAC | A tricellulose film support containing 20 g of barium sulfate in 100 g of tetra cellulose |
| PP | A polypropylene film support containing 20 g of barium sulfate in 100 g of polypropylene |
| PET | A polyester film support containing 20 g of barium sulfate in 100 g of polyester (polyethylene terephthalate) |
| PVC/PVCD | A vinyl chloride - vinylidene chloride copolymer resin film support containing 20 g of barium sulfate in 100 g of vinyl chloride - vinylidene chloride copolymer resin |

employing each sample, the following evaluation was conducted.

Evaluation of Magenta Dye on Light-Fastness

Samples were subjected to expose green light through an optical wedge and to the following processing to obtain magenta coloring dye images. In order to evaluate light-fastness of the magenta coloring dye image of each samples, the residual density at the initial density of 1.0 after each sample was subjected to light for 100 hours at 45,000 lux was measured by means of xenon fademeter.

Evaluation of Red Color Reproducibility

A negative film made by Konica color DD-100 film, in which a Macbeth's color checker was photographed was printed on each sample employing an enlarger. They were subjected to the same processing as in the case of evaluation on light-fastness. The obtained prints were subjected to 5-rank evaluation in terms of red reproduction mainly by 20 panellers. The evaluations are shown by average values.

5—red color is extremely excellent
4—red color is slightly excellent
3—red color is normal
2—red color is slightly inferior
1—red color is extremely inferior The entire results are shown in Table 4.

| Processing steps | Time | Temperature |
|---|---|---|
| Color developing | 3 min. and 30 sec. | 33° C. |
| Bleach fixing | 1 min. and 30 sec. | 33° C. |
| Washing | 3 min. | 33° C. |
| Drying | 1 min. | 60–80° C. |
| Color developing agent | | |
| N-ethyl-N-β-methanesulfonamidoethyl-3-methyl-4-aminoaniline sulfate | | 4.9 g |
| Hydroxylamine sulfate | | 2.0 g |
| Potassium carbonate | | 25.0 g |
| Potassium bromide | | 0.6 g |
| Sodium sulfite anhydride | | 2.0 g |
| Benzyl alcohol | | 13 ml |
| Diethylenetriaminepentacetate | | 3.0 g |
| Triethanol amine | | 10.0 g |
| Diethyleneglycol | | 10.0 g |
| Add water to make 1,000 ml, and adjust pH to 10.0 with sodium hydroxide. | | |
| Bleach fixer | | |
| Ammonium ferric ethylenediaminetetraacetate | | 65 g |
| Ammonium thio sulfate | | 100 g |
| Sodium sulfite | | 10 g |
| Sodium meta heavy sulfite | | 3 g |
| Add water to make 1 l, and adjust pH to 7.0 with aqueous ammonia and acetic acid. | | |

TABLE 4

| Sample No. | Support | Oxygen permeability* | Magenta coupler | Light fastness of magneta image | Red color reproducibility |
|---|---|---|---|---|---|
| 101 (Comparative) | PE | 400 | MM-1 | 0.46 | 3.2 |
| 102 (Comparative) | TAC | 40 | MM-1 | 0.49 | 3.3 |
| 103 (Comparative) | PP | 20 | MM-1 | 0.51 | 3.3 |
| 104 (Comparative) | PE | 400 | M-1 | 0.45 | 2.0 |
| 105 (Comparative) | PE | 400 | M-2 | 0.23 | 4.1 |
| 106 (Comparative) | PET | 0.3 | M-1 | 0.60 | 2.5 |
| 107 (Comparative) | PET | 0.3 | M-2 | 0.48 | 4.2 |
| 108 (Invention) | PET | 0.3 | MM-1 | 0.67 | 4.5 |
| 109 (Invention) | PET | 0.3 | MM-2 | 0.66 | 4.4 |
| 110 (Invention) | PET | 0.3 | MM-3 | 0.67 | 4.4 |

TABLE 4-continued

| Sample No. | Support | Oxygen perme-ability* | Magenta coupler | Light fastness of magneta image | Red color reproduci-bility |
|---|---|---|---|---|---|
| 111 (Invention) | PVP/PVCD | 0.5 | MM-1 | 0.65 | 4.5 |

*ml/m$^2$ · hr · atm (20° C. · Dry)

MM-1

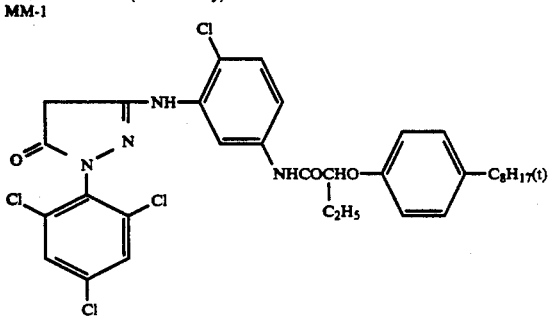

MM-2

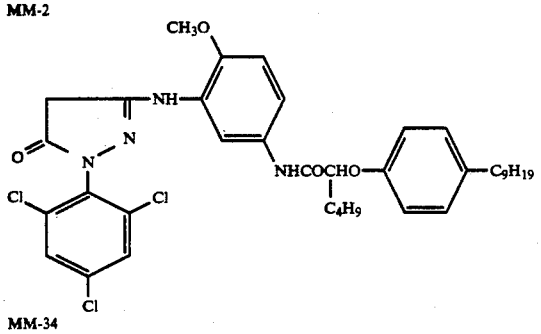

MM-34

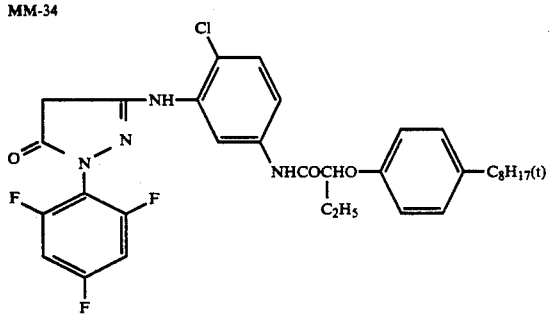

As is apparent from Table 4, samples employing magenta couplers in the present invention and a support of not more than 2.0 ml/m$^2$·hr·atom in terms of oxygen permeability are excellent in light-fastness and red color reproducibility.

That the evaluation on red color reproducibility was improved remarkably when magenta couplers in the present invention and supports in the present invention are employed was an unexpected effect to the inventors.

Example 2

On a support PE used in Example 1, layers having constitutions shown in Tables 5 and 6 were coated on a side of a polyethylene layer containing titanium oxide to prepare multi-layer light-sensitive material samples.

The coating solution was prepared in the following manner.

Coating Solution for the First Layer

To 26.7 g of a yellow coupler (Y-1), 10.0 g of a dye image stabilizer (ST-1), 0.67 g of an additive and 6.67 g of a high boiling organic solvent (DNP), 60 ml of ethyl acetate was added to be dissolved. The solution was emulsified and dispersed to 220 ml of 10% aqueous gelatin solution containing 7 ml of 20% surfactant (SU-3) by means of supersonic homogenizer to prepare a yellow coupler dispersion. This dispersion was mixed with a blue sensitive silver halide emulsion prepared under the following conditions containing 10 g of silver to prepare the coating solution for the first layer.

The coating solutions for the second layer to the seventh layer were prepared in the manner similar to that of as the coating solution for the first layer.

In addition, (H-2) was added to the second layer and the fourth layer, and (H-1) was added to the seventh layer as a hardener. As coating aids, surfactants (SU-1) and (SU-2) were added so that the surface tension was adjusted.

TABLE 5

| Layer | Constitution | Added amount (g/m$^2$) |
|---|---|---|
| First layer (Blue sensitive layer) | Gelatin | 1.20 |
| | Blue sensitive silver bromochloride emulsion (Em-B) | 0.26 |
| | Yellow coupler (Y-1) | 0.80 |
| | Dye image stabilizer (ST-1) | 0.30 |
| | Dye image stabilizer (ST-2) | 0.20 |
| | Anti-stain agent (HQ-1) | 0.02 |

TABLE 5-continued

| Layer | Constitution | Added amount ($g/m^2$) |
|---|---|---|
| | Anti-irradiation dye (AI-4) | 0.01 |
| | DNP | 0.20 |
| Second layer (Intermediate layer) | Gelatin | 1.20 |
| | Anti-stain agent (HQ-4) | 0.03 |
| | Anti-stain agent (HQ-5) | 0.03 |
| | Anti-stain agent (HQ-6) | 0.05 |
| | Anti-stain agent (HQ-7) | 0.23 |
| | DIDP | 0.06 |
| | Compound (F-1) | 0.002 |
| Third layer (Green sensitive layer) | Gelatin | 1.40 |
| | Green sensitive silver bromochloride emulsion (Em-G) | 0.30 |
| | Magenta coupler (M-1) | 0.35 |
| | Dye image stabilizer (ST-3) | 0.15 |
| | Dye image stabilizer (ST-4) | 0.15 |
| | Dye image stabilizer (ST-5) | 0.15 |
| | DNP | 0.20 |
| | Anti-irradiation dye (AI-1) | 0.01 |
| Fourth layer (UV absorber) | Gelatin | 0.94 |
| | UV absorber (UV-1) | 0.28 |
| | UV absorber (UV-1) | 0.09 |
| | UV absorber (UV-1) | 0.38 |
| | Color mixture preventing agent (HQ-7) | 0.10 |
| | DNP | 0.40 |

TABLE 6

| Layer | Constitution | Added amount ($g/m^2$) |
|---|---|---|
| Fifth layer (Red sensitive layer) | Gelatin | 1.30 |
| | Red sensitive silver bromochloride emulsion (Em-R) | 0.21 |
| | Cyan coupler (C-2) | 0.25 |
| | Cyan coupler (C-3) | 0.17 |
| | Dye image stabilizer (ST-1) | 0.20 |
| | Anti-stain agent (HQ-1) | 0.01 |
| | HBS-1 | 0.20 |
| | DOP | 0.20 |
| Sixth layer (UV absorber) | Gelatin | 0.40 |
| | UV absorber (UV-1) | 0.10 |
| | UV absorber (UV-2) | 0.04 |
| | UV absorber (UV-3) | 0.16 |
| | Anti-stain agent (HQ-7) | 0.04 |
| | DNP | 0.20 |
| | PVP | 0.03 |
| | Anti-irradiation dye (AI-2) | 0.01 |
| | Anti-irradiation dye (AI-3) | 0.02 |
| Seventh layer (Protective layer) | Gelatin | 1.00 |
| | Anti-stain agent (HQ-4) | 0.002 |
| | Anti-stain agent (HQ-5) | 0.002 |
| | Anti-stain agent (HQ-6) | 0.004 |
| | Anti-stain agent (HQ-7) | 0.02 |
| | DIDP | 0.005 |
| | Compound (F-1) | 0.002 |

Added amounts of silver halide emulsion are given in terms of silver.

Additives used are as follows:

C-3

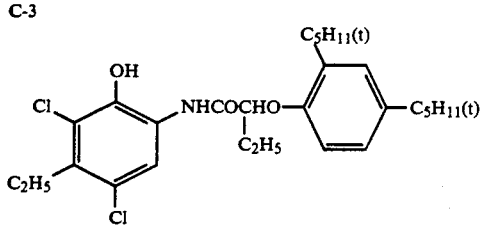

ST-5

-continued

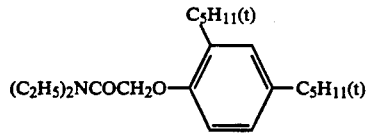

AI-4

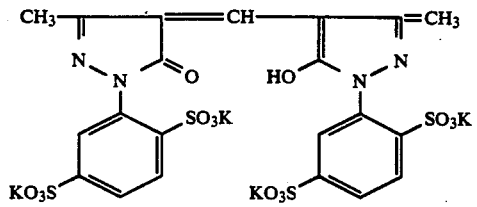

HQ-4: 2,5-di-sec-dodecylhydroquinone
HQ-5: 2,5-di-sec-tetradecylhydroquinone
HQ-6: 2-sec-dodecyl-5-sec-tetradecylhydroquinone
HQ-7: 2,5-di-[(1,1-dimethyl-4-hexyloxycarbonyl) butyl] hydroquinone
PVP: Polyvinylpyrrolidone
HBS-1: N-(4-dodecylphenyl)-p-toluenesulfonamide Preparation of Blue Sensitive Silver Halide Emulsion To 1000 ml of 2% gelatin aqueous solution kept at 40°, the following solutions A and B were added concurrently for 30 minutes controlling pAg at 6.5 and pH at 3.0. In addition, the following solutions C and D were added for 180 minutes controlling pAg at 7.3 and pH at 5.5. At that time, pAg was controlled by means of a method described in Japanese Patent O.P.I. Publication No. 45437/1984, and pH was controlled using sulfuric acid or sodium hydroxide.

| | |
|---|---|
| (Solution A) | |
| Sodium chloride | 3.42 g |
| Potassium bromide | 0.03 g |
| Add water to make 200 ml. | |
| (Solution B) | |
| Silver nitrate | 10 g |
| Add water to make 200 ml. | |
| (Solution C) | |
| Sodium chloride | 102.7 g |
| Potassium bromide | 1.0 g |
| Add water to make 600 ml. | |
| (Solution D) | |
| Silver nitrate | 300 g |
| Add water to make 600 ml. | |

After addition, the solution was desalted employing 5% aqueous solution of Demol N produced by Kao Atlas and 20% aqueous solution of magnesium sulfate, and then, mixed with gelatin aqueous solution to prepare a mono-dispersed cubic emulsion EMP-1 having an average grain size of 0.85 μm, a variation coefficient of grain size distribution of 0.07 and silver chloride content ratio of 99.5 mol %. The variation coefficient of grain size distribution is calculated by the equation of $\sigma/\bar{r}$, in which $\sigma$ and $\bar{r}$ are a standard deviation of size distribution and an average size of the grains respectively.

The above-mentioned emulsion EMP-1 was subjected to chemical ripening for 90 minutes at 50 ° C. employing the following compounds to prepare a blue sensitive silver halide emulsion Em-B.

| | |
|---|---|
| Sodium thiosulfate | 0.8 mg/mol AgX |
| Chloro aurate | 0.5 mg/mol AgX |
| Stabilizer STAB-2 | $6 \times 10^{-4}$ mol/mol AgX |
| Sensitizing dye BS-2 | $4 \times 10^{-4}$ mol/mol AgX |
| Sensitizing dye BS-3 | $1 \times 10^{-4}$ mol/mol AgX |

Preparation of Green Sensitive Silver Halide Emulsion

In the same manner as EMP-1 except that the adding time of Solutions A and B and Solutions C and D, a mono-dispersed cubic emulsion EMP-2 having an average grain size of 0.43 μm, a variation coefficient of 0.08 and a silver chloride content ratio of 99.5 mol %.

EMP-2 was subject to chemical ripening for 120 minutes at 55° C. employing the following compounds to prepare a green sensitive silver halide emulsion Em-G.

| | |
|---|---|
| Sodium thiosulfate | 1.5 mg/mol AgX |
| Chloro aurate | 1.0 mg/mol AgX |
| Stabilizer STAB-2 | $6 \times 10^{-4}$ mol/mol AgX |
| Sensitizing dye GS-1 | $4 \times 10^{-4}$ mol/mol AgX |

Preparation of Red Sensitive Silver Halide Emulsion

In the same manner as EMP-1 except that the adding time of Solutions A and B and Solutions C and D, a mono-dispersed cubic emulsion EMP-3 having an average grain size of 0.50 μm, a variation coefficient of 0.08 and a silver chloride content ratio of 99.5 mol %.

EMP-3 was subjected to chemical ripening for 90 minutes at 60° C. employing the following compounds to prepare a red sensitive silver halide emulsion Em-R.

| | |
|---|---|
| Sodium thiosulfate | 1.8 mg/mol AgX |
| Chloro aurate | 2.0 mg/mol AgX |
| Stabilizer STAB-2 | $6 \times 10^{-4}$ mol/mol AgX |
| Sensitizing dye GS-1 | $1 \times 10^{-4}$ mol/mol AgX |

STAB-2: 1-(3-acetoamino)phenyl-5-mercaptotetrazole

BS-2

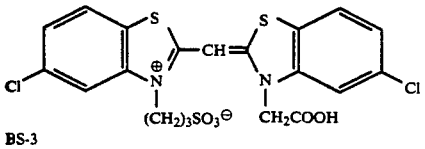

BS-3

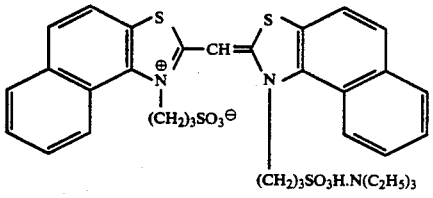

A sample thus obtained was defined to be Sample 201. In addition, Samples 202 to 214 were obtained in the same manner as Sample 201 except that the support and the magenta couplers in in the third layer were replaced as shown in Table 7.

Each sample was exposed to light by means of a conventional method, and then, they were processed under the following processing steps.

| Processing step | Temperature | Time |
|---|---|---|
| Color developing | 35.0 ± 0.3° C. | 45 sec. |
| Bleach fixing | 35.0 ± 0.5° C. | 45 sec. |
| Stabilizing | 30–34° C. | 90 sec. |
| Drying | 60–80° C. | 60 sec. |

| | |
|---|---|
| Color developing solution | |
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-disulfonic acid | 1.0 g |
| Ethylenediamine tetraacetate | 1.0 g |
| Disodium catecol-3,5-disulfonate | 1.0 g |
| Diethyleneglycol | 10.0 g |
| N-ethyl-N-β-methanesulfonamidoethyl-3-methyl-4-aminoaniline sulfate | 4.5 g |
| Fluorescent brightening agent (4,4'-diaminostylbenzsulfonic acid derivative) | 1.0 g |
| Potassium carbonate | 27.0 g |
| Add water to make 1,000 ml, and adjust pH to 10.0. | |
| Bleach-fixing solution | |
| Ammonium ferric ethylenediamine tetraacetate dihydrate | 60.0 g |
| Ethylenediaminetetraacetate | 3.0 g |
| Ammonium thiosulfate (70% aqueous solution) | 100 ml |
| Ammonium sulfite (40% aqueous solution) | 27.5 ml |
| Add water to make 1,000 ml, and adjust pH to 5.7 with potassium carbonate or glacial acid. | |
| Stabilizer | |
| 5-chloro-2-methyl-4-isothiazoline-3-on | 0.2 g |
| 1,2-benzoisothiazoline-3-on | 0.3 g |
| Ethylene glycol | 1.0 g |
| 1-hydroxyethylidene-1,1-diphosphate | 2.0 g |
| Sodium o-phenylphenol | 1.0 g |
| Ethylenediamine tetraacetate | 1.0 g |
| Ammonium hydroxide (20% aqueous solution) | 3.0 g |
| Fluorescent brightening agent (4,4'-diaminostylbenzsulfonic acid derivative) | 1.5 g |
| Add water to make 1,000 in total, and adjust pH to 7.0 with sulfuric acid or potassium hydroxide. | |

The light-fastness and red reproducibility of the magenta dye of the processed samples were evaluated in the same manner as Example 1. The results are shown in Table 7.

TABLE 7

| Sample No. | Support | Magenta coupler | Light-fastness of magenta dye image | Red color reproducibility |
|---|---|---|---|---|
| 201 (Comparative) | PE | MM-1 | 0.45 | 3.3 |
| 202 (Comparative) | TAC | MM-1 | 0.49 | 3.3 |
| 203 (Comparative) | PP | MM-1 | 0.50 | 3.4 |
| 204 (Comparative) | PE | MM-1 | 0.43 | 3.1 |
| 205 (Comparative) | PE | M-1 | 0.44 | 2.0 |
| 206 (Comparative) | PE | M-2 | 0.23 | 4.2 |
| 207 (Comparative) | PET | M-1 | 0.61 | 2.2 |
| 208 (Comparative) | PET | M-2 | 0.48 | 4.3 |

TABLE 7-continued

| Sample No. | Support | Magenta coupler | Light-fastness of magenta dye image | Red color reproducibility |
|---|---|---|---|---|
| 209 (Invention) | PET | MM-1 | 0.68 | 4.5 |
| 210 (Invention) | PET | MM-2 | 0.66 | 4.3 |
| 211 (Invention) | PET | MM-4 | 0.67 | 4.4 |
| 212 (Invention) | PET | MM-5 | 0.66 | 4.4 |
| 213 (Invention) | PET | MM-3 | 0.65 | 4.3 |
| 214 (Invention) | PVP/PVCD | MM-1 | 0.65 | 4.5 |

MM-4

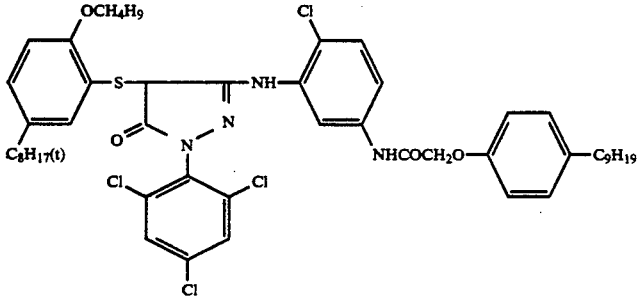

MM-5

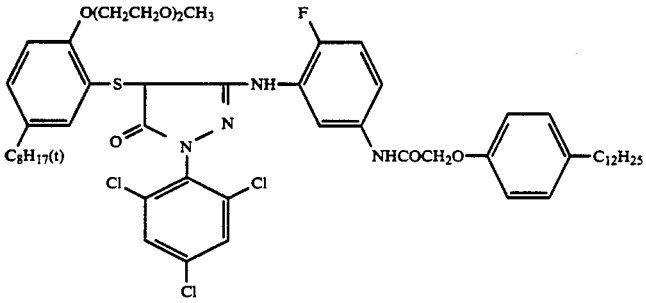

From the results shown in Table 7, it turned out that the light-fastness and red reproducibility of magenta dye image can be improved by employing supports and magenta couplers in the present invention.

EXAMPLE 3

Sample 301 was prepared in the same manner as Sample 208 in Example 2, except that the amount of gelatin in the sixth layer was 0.6 g/m$^2$ and that in the seventh layer was 1.5 g/m$^2$.

The total amount of hydrophilic binder (gelatin) in Sample 208 was 7.44 g/m$^2$ and that in sample 301 was 14 g/m$^2$.

Samples 208 and 301 were subjected to exposure to light and development processing in the same manner as Example 1, and then, their feeling of stickiness was investigated by touching with a hand. It turned out that Sample 208 showed less stickiness than Sample 301. Namely, it is a preferable embodiment of the present invention that the total amount of hydrophilic binder is not more than 8.0 g/m$^2$.

What is claimed is:

1. A silver halide photographic light-sensitive material comprising a reflective support having thereon a silver halide emulsion layer wherein said support have an oxygen permeability of not more than 2.0 ml/m$^2$·hr·atm and said silver halide emulsion layer contains a magenta coupler represented by the following Formula I;

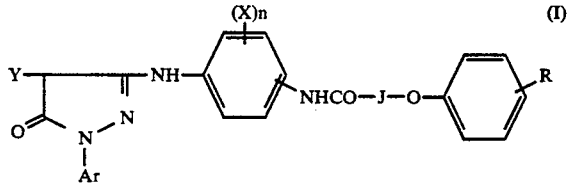

wherein Ar is an aryl group; Y is a hydrogen atom or a substituent capable of splitting off upon reaction with the oxidation product of a color developing agent; X is a halogen atom, an alkoxy group or an alkyl group; R is a strait- or branched-chain alkyl group having 1 to 20 carbon atoms; J is a strait-chained or branched-chain alkylene group; and n is an integer of from 0 to 4, the plurality of Xs may be the same or different when n is 2 or more.

2. The light-sensitive material of claim 1, wherein said support has an oxygen permeability of not more than 1.0 ml/m$^2$·hr·atm.

3. The light-sensitive material of claim 1, wherein said support is a polyester film.

4. The light-sensitive material of claim 1, wherein said silver halide emulsion layer contains said magenta coupler in an amount of from $1\times10^{-3}$ to 833 $10^{-1}$ mol per mol of silver halide contained in said silver halide emulsion layer.

5. The light-sensitive material of claim 1, wherein the total amount of binder coated on the surface of said support on which said silver halide emulsion layer provided is 5.0 g/m$^2$ to 8.0 g/m$^2$.

* * * * *